US006282747B1

(12) United States Patent
Morgan et al.

(10) Patent No.: US 6,282,747 B1
(45) Date of Patent: Sep. 4, 2001

(54) HANDLE OPERATED POWER DRIVE LINK LOCKOUT

(75) Inventors: Jeffrey A. Morgan, Cuyahoga Falls; Jeffrey S. Louis, Green; Kevin L. Thomas, North Canton, all of OH (US)

(73) Assignee: The Hoover Company, North Canton, OH (US)

( * ) Notice: Subject to any disclaimer, the term of this patent is extended or adjusted under 35 U.S.C. 154(b) by 19 days.

(21) Appl. No.: 09/603,599

(22) Filed: Jun. 26, 2000

(51) Int. Cl.[7] ..... A47L 9/00
(52) U.S. Cl. ..... 15/340.2; 180/19.3
(58) Field of Search ..... 15/340.2; 180/19.3

(56) References Cited

U.S. PATENT DOCUMENTS

| | | | | |
|---|---|---|---|---|
| 2,814,063 | * | 11/1957 | Ripple | 15/340.2 X |
| 3,218,876 | * | 11/1965 | Berger | 15/340.2 X |
| 3,618,687 | | 11/1971 | Ripple et al. . | |
| 4,249,281 | | 2/1981 | Meyer et al. . | |
| 4,347,643 | | 9/1982 | Blair, III . | |
| 4,615,071 | | 10/1986 | Frohbieter . | |
| 4,754,520 | | 7/1988 | Steadings et al. . | |
| 4,766,640 | | 8/1988 | Martin et al. . | |
| 5,115,537 | * | 5/1992 | Meyer et al. | 15/340.2 |
| 5,335,740 | | 8/1994 | Meyer et al. . | |
| 5,339,916 | * | 8/1994 | Louis | 15/340.2 X |
| 5,974,622 | | 11/1999 | Louis et al. . | |

* cited by examiner

*Primary Examiner*—Chris K. Moore
(74) *Attorney, Agent, or Firm*—A. Burgess Lowe

(57) ABSTRACT

A self-propelled upright vacuum cleaner is provided having a lower portion and an upright handle portion pivotally attached to the floor engaging portion for a pivotal motion between an upright storage position and a pivotal operating position including a transmission operatively connected to a drive wheel and a motor drivingly connected to the transmission for driving the drive wheel in forward and reverse. A clutch engaging member is pivotally mounted to the floor engaging portion adjacent to the transmission for pivotal motion about a pivot axis located generally at a forward portion of the clutch engaging member. Operably associated with the clutch engaging member is a transverse linking member that reciprocates from a neutral position in first and second directions in response to pivotal motion of a bottom link. The reciprocation of the transverse link selectively moves said clutch engaging member from a neutral position to a forward drive position and a reverse drive position. A finger link member carried on the housing assembly is selectively positioned in a channel formed on the bottom link, relative to the pivotal positioning of the housing assembly. Pivotal motion of the finger link engages the bottom link member when the housing assembly and handle portion are in an operative inclined position and does not engage the bottom link member when the housing assembly and handle portion are in a storage upright position.

8 Claims, 9 Drawing Sheets

HANDLE OPERATED POWER DRIVE LINK LOCKOUT

BACKGROUND OF THE INVENTION

1. Field of the Invention

This invention pertains to self-propelled upright vacuum cleaners. More specifically, this invention pertains to a novel linkage mechanism for automatically preventing engagement of the transmission on a self-propelled upright vacuum cleaner when the handle or upper housing portion of the cleaner is placed in its upright storage position.

2. Description of Related Prior Art

It is known in the prior art to provide an upright vacuum cleaner with a transmission in the foot or lower floor engaging portion of the cleaner and a transmission actuator member mounted to the foot adjacent to the transmission. A Bowden cable typically extends from the actuator on the foot to a hand grip that is reciprocally mounted for rectilinear motion to the top of the housing or handle portion of the cleaner.

Prevention of accidental engagement of the transmission when the housing is in the upright storage position is a problem that has been addressed in the art. For example, it is known to provide a member on the lower end of the housing or handle portion of the vacuum cleaner that will engage the transmission actuator, or actuate a member on the foot that engages the transmission actuator, and thereby place and lock the transmission actuator in its neutral position. Thus, if an operator were to accidentally bump the hand grip while the cleaner's housing is in the upright storage position and the motor is running, the transmission is prevented from being engaged and the cleaner is prevented from accidentally propelling itself across the floor. Such transmission neutral locking arrangements for self-propelled upright vacuum cleaners are disclosed in U.S. Pat. Nos. 4,766,640; 4,347,643; and 4,249,281.

It is also known to position the transmission actuator relative to the lower end of the housing such that a member carried on the housing directly contacts the actuator to selectively engage the transmission when the housing is in its inclined operating position and is prevented from contacting the actuator when the housing is in its upright storage position. When the transmission is not being engaged by the actuator, the transmission is self-biased into an idling neutral position. An example of this type of self-propelled vacuum cleaner can be found in U.S. Pat. No. 3,618,687.

Further, U.S. Pat. No. 5,974,622 discloses a self-propelled upright vacuum cleaner having a lower portion and an upright handle pivotally attached to the floor engaging portion for a pivotal motion between an upright storage position and a pivotal operating position. First and second cams extend from the handle portion and are located to engage the actuator arm at two locations spaced to either side of the pivot axis of the actuator arm when the handle is raised to the upright storage position, whereby the cams place and lock the actuator arm in the neutral position when the handle portion is pivoted to the upright storage position.

The present invention utilizes a novel mechanical linking mechanism to actuate the transmission to place the transmission in forward, reverse or neutral when the handle is in an inclined, operative position. When the handle is in a upright storage position, the linkage is inoperable, thereby preventing the cleaner from being inadvertently propelled along the floor.

It is therefore an object of the present invention to provide an improved linking mechanism to actuate the transmission of a self-propelled upright vacuum cleaner wherein the linkage mechanism between the handle portion and the clutch engaging device is operational only when the housing and handle portion are in an inclined position and is inoperable when the assembly and handle portion of the vacuum cleaner is in a fully upright position.

It is a further object of the present invention to provide a method for actuating the transmission of a self-propelled upright vacuum cleaner when the assembly and handle of the vacuum cleaner is in an inclined, operative position, and disengaging the transmission of the vacuum cleaner when the assembly and handle of the vacuum cleaner is in a fully upright position.

SUMMARY OF THE INVENTION

These and other objects are achieved in one embodiment of the present invention wherein there is provided a self-propelled upright vacuum cleaner having a floor engaging portion, a housing assembly pivotally attached to said floor engaging portion for a pivotal motion between a generally upright storage position and a pivotal inclined operating position, and a handle portion carried on said housing assembly at a position spaced from said floor engaging portion. The handle portion is adapted for limited reciprocal movement relative to the housing assembly. At least one floor engaging drive wheel mounts to and extends out a lower surface of the floor engaging portion. A transmission operatively connects to the drive wheel and a motor drivingly connects to the transmission for selectively driving the drive wheel in forward and reverse. A clutch engaging member pivotally mounts to the floor engaging portion adjacent to the transmission for pivotal motion about a pivot axis located generally at a forward portion of the clutch engaging member. A first linkage is carried on the floor engaging portion and mounted thereto at a location spaced from the clutch engaging member. The first linkage selectively moves the clutch engaging member from a neutral position to a forward drive position and a reverse drive position. A second linkage is carried on the housing assembly for selectively engaging the first linkage in response to the reciprocal movement of the handle portion. The second linkage is operably positioned relative to the first linkage when the housing assembly is in the inclined operating position and is inoperably positioned relative to the first linkage when the housing assembly is in the upright storage position.

These and other objects are further achieved in one embodiment thereof by the present method for actuating a transmission in a self-propelled vacuum cleaner. A clutch engaging member is pivotally mounted to a floor engaging portion adjacent to the transmission for pivotal motion about a first pivot axis located generally at a forward portion of the clutch engaging member. A first linkage selectively moves the clutch engaging member from a neutral position to a forward drive position and a reverse drive position. The first linkage is carried on the floor engaging portion and is mounted thereto at a location spaced from the clutch engaging member. A second linkage selectively engages the first linkage and is carried on the housing assembly and is operable in response to reciprocal movement of a handle portion. The second linkage is operably positioned relative to the first linkage when the housing assembly is in the inclined operating position, and is inoperably positioned relative to the first linkage when the housing assembly is in the upright storage position. The housing assembly is inclined to operably position the second linkage. The handle portion is manipulated to operate the second linkage and thereby selectively engage the first linkage. The clutch engaging member with the first linkage is selectively moved from the neutral position to one of the drive positions.

BRIEF DESCRIPTION OF THE DRAWINGS

One embodiment of the present invention will now be described, by way of example, with reference to the accompanying drawings, of which.

Similar numeral refer to similar parts throughout the drawings.

DETAILED DESCRIPTION OF THE INVENTION

Figure 1:
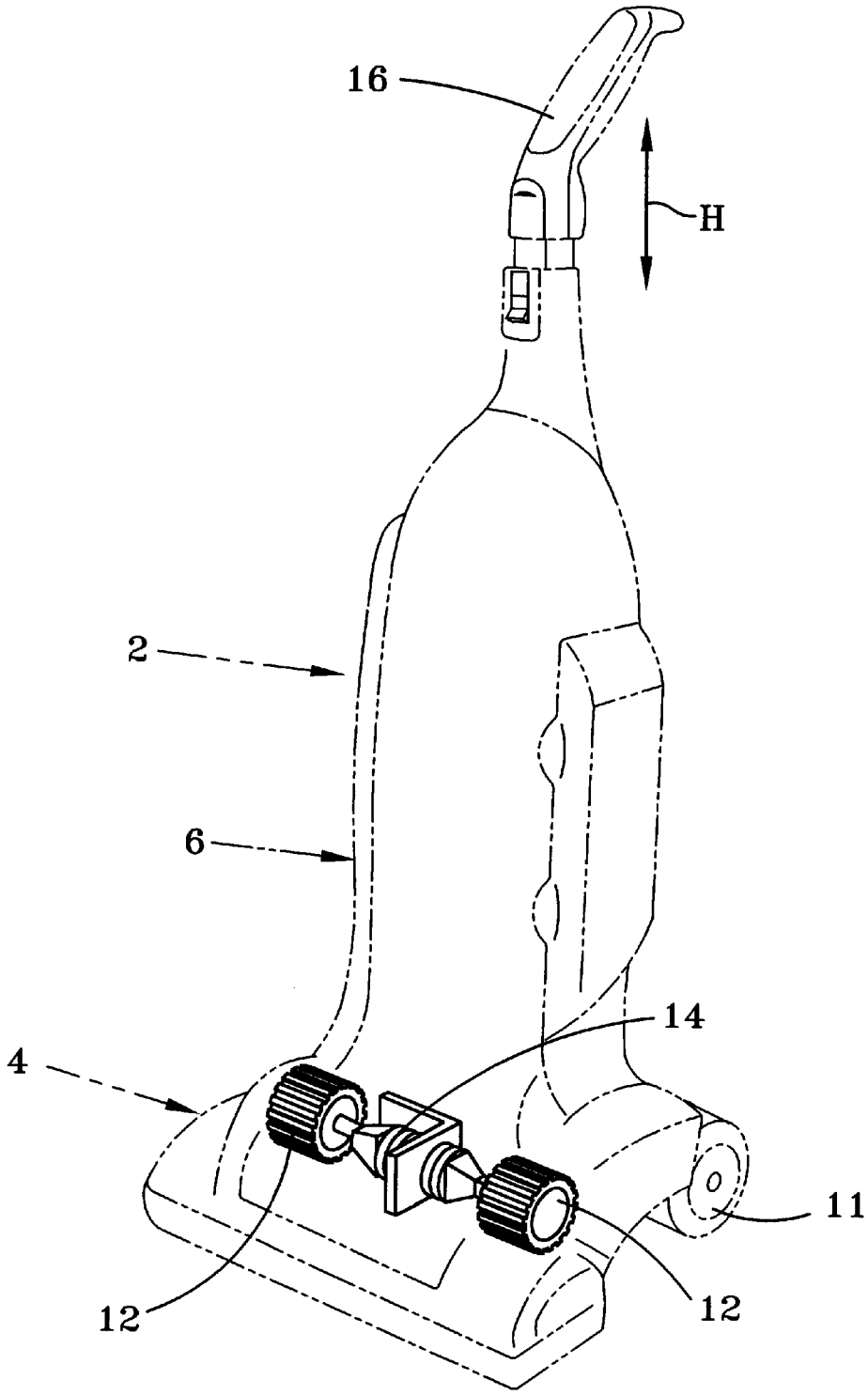
FIG. 1 is a diagrammatic perspective view of a self-propelled upright vacuum cleaner according to the present invention.

A self-propelled upright vacuum cleaner 2 according to one embodiment of the present invention is diagrammatically illustrated by way of example in FIG. 1. The cleaner includes a foot or lower floor engaging portion 4 and an upper portion or housing assembly 6 pivotally mounted to the lower portion in a conventional manner for pivotal motion from a generally upright latched storage position, illustrated in FIG. 1, to a generally inclined operating position, not shown. Although housing assembly 6 is shown in FIG. 1 as a bag housing, it is understood that vacuum cleaner 2 could be a bagless upright vacuum cleaner having an upper position with a dirt cup or container rather than a bag and bag housing without affecting the concept of the invention. A pair of rear support wheels 11 (only one of which is visible in FIG. 1), and a pair of drive wheels 12 cooperate to support the cleaner on a floor surface. The drive wheels 12 are selectively driven in forward and reverse by a transmission 14.

A hand grip 16 is mounted to a top of the housing assembly 6 for limited reciprocal rectilinear motion relative to the housing assembly as indicated by arrow H in FIG. 1. The hand grip 16 is selectively linked to the transmission 14, as will be explained in further detail below, in order to enable the transmission 14 to be actuated to drive the cleaner in the forward and reverse directions as an operator respectively pushes and pulls on the hand grip 16.

The details of the transmission 14 do not form a part of the present invention and are therefore not disclosed in detail herein. However, a suitable transmission for use with a self-propelled upright vacuum cleaner according to the present invention is disclosed in expired U.S. Pat. No. 3,581,591, the disclosure of which is hereby incorporated herein as of reference. Likewise, the details of the reciprocating hand grip do not form a part of the present invention and are therefore not described in detail herein. Suitable hand grips for use with a self-propelled upright vacuum cleaner according to the present invention are disclosed in U.S. Pat. Nos. 3,618,687 and 5,339,916, the disclosures of which are hereby incorporated herein as of reference.

Figure 2:
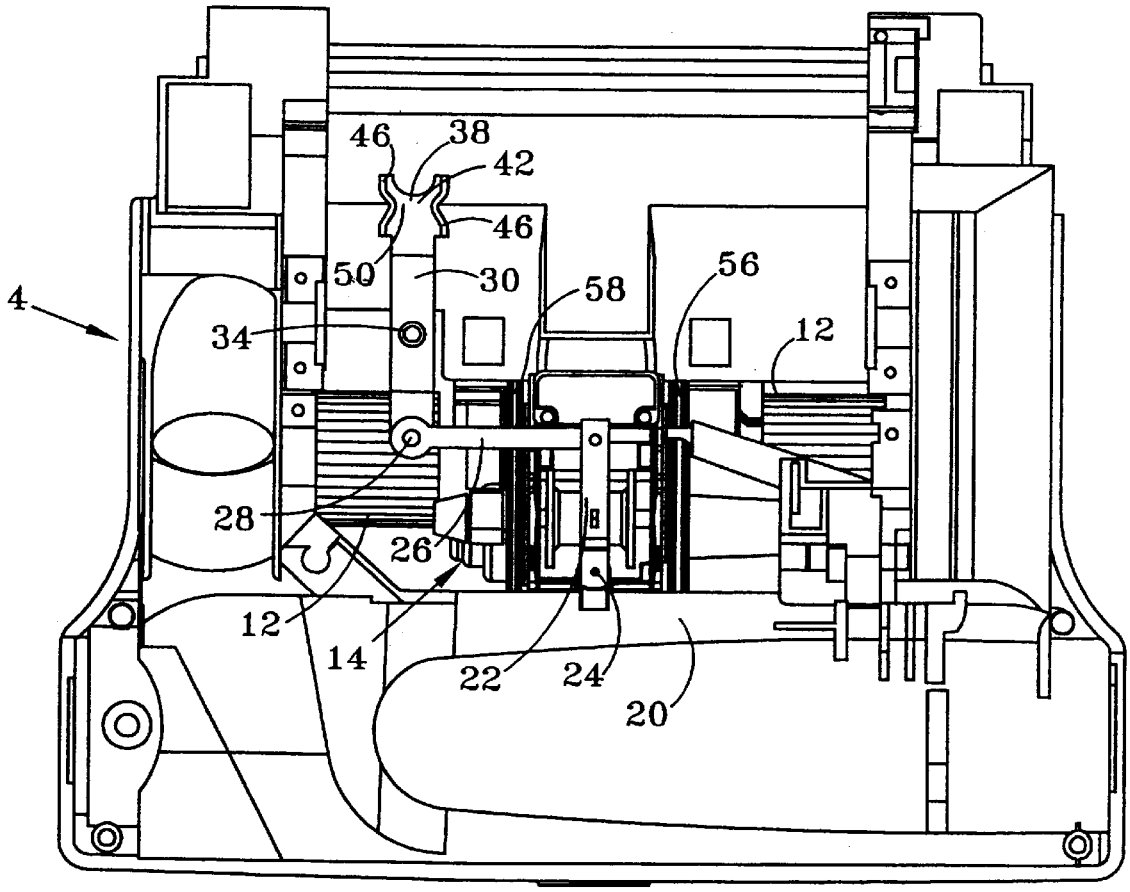
FIG. 2 is a partial top plan view of the foot portion of the vacuum cleaner with the hood removed.
Figure 3:
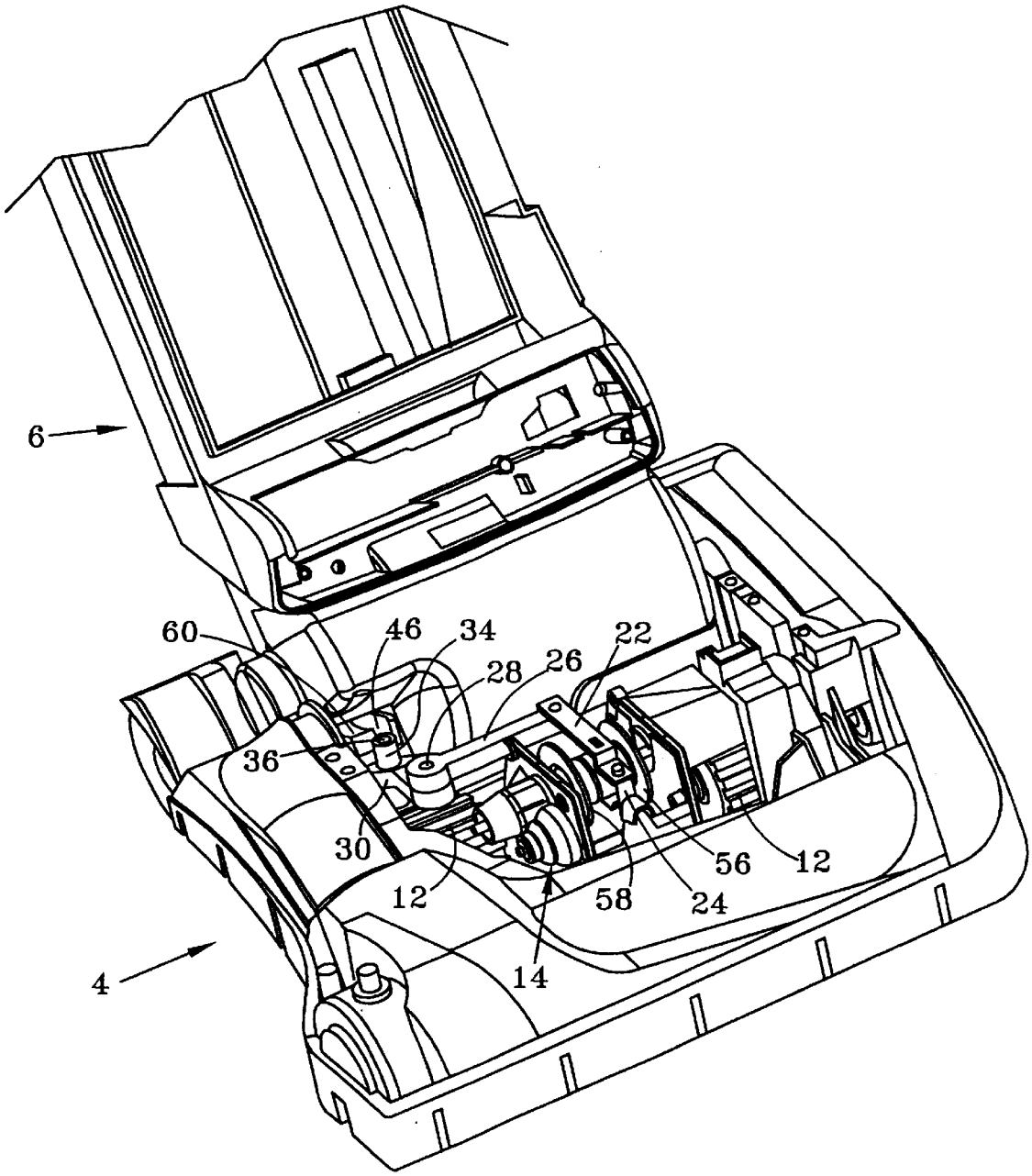
FIG. 3 is a partial perspective view of the self-propelled upright vacuum cleaner shown in FIG. 1 with the hood or housing on the lower portion of the cleaner removed and with the housing assembly in the inclined operating position.

Referring now to FIGS. 2 and 3, the transmission 14 is mounted to the front edge of a main frame or carriage 20 and the pair of drive wheels 12 are mounted to the transmission output shaft (not shown). The drive wheels are located toward the front of the carriage 20, the support wheels 11 (shown in FIG. 1) are located to the rear of the carriage 20 and the housing assembly 6 is pivotally mounted to the carriage between the drive wheels and the support wheels, such that the support wheels and the drive wheels cooperate to support the weight of the cleaner on a floor surface.

A clutch engaging member 22 is pivotally mounted onto a mounting post 24 extending up from the carriage 20 toward the front of the transmission 14. The clutch engaging member 22 is attached to a transverse link 26 at a first end spaced from the mounting post 24. The transverse link 26 is pivotally connected to a first end 28 of a longitudinal or bottom link 30. The bottom link 30 is formed with a hole 36 near the lengthwise center of thereof. The hole 36 (FIG. 6) receives a post 34 which extends up from the carriage 20 to pivotally mount the bottom link 30 to carriage 20. A second end 38 of the bottom link 30 is formed with a channel 42 defined by modified V-shaped opposed side walls 46 which converge to provide a local constriction 50 in channel 42.

Figure 5:
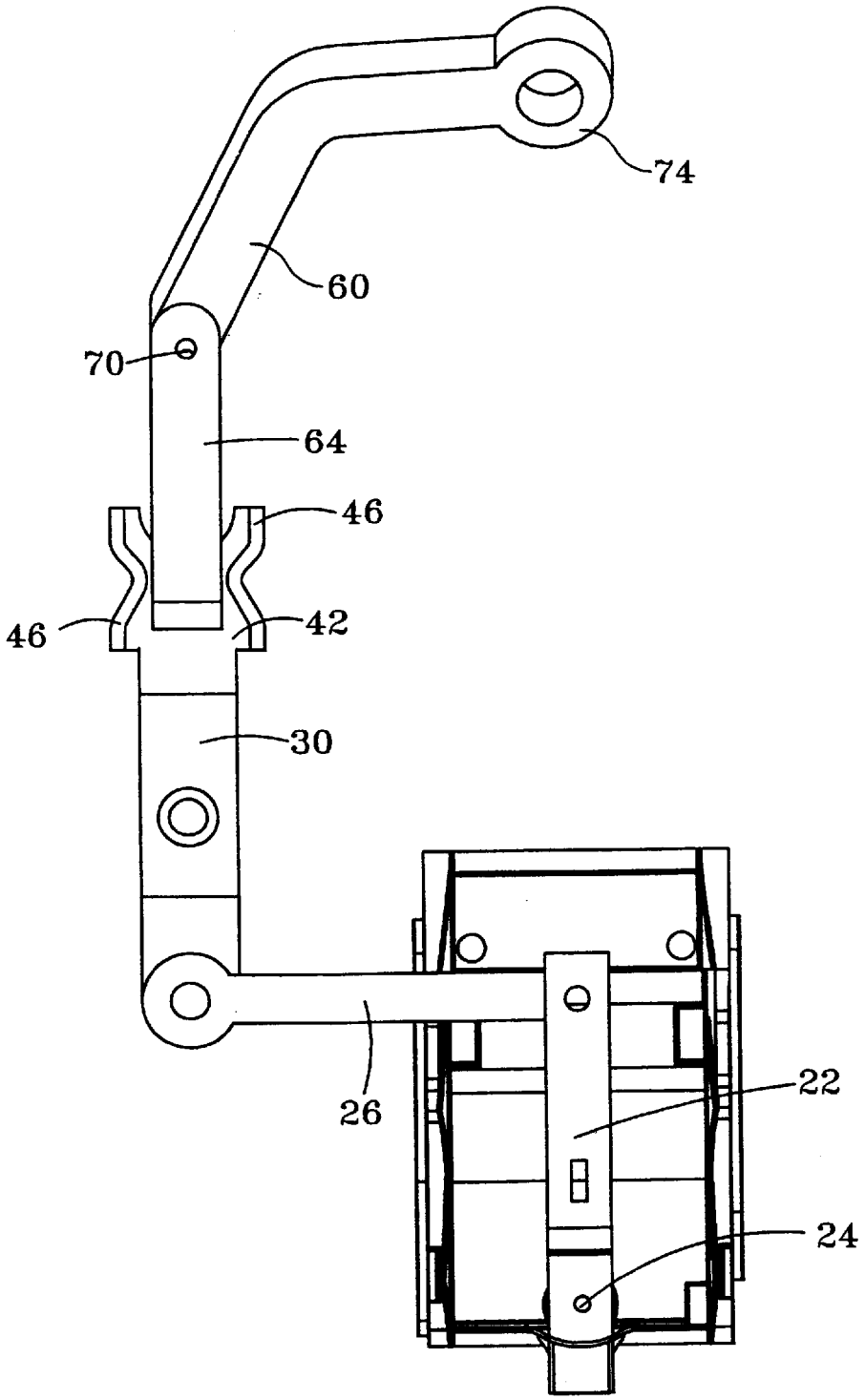
FIG. 5 is a partial top view of one embodiment of an inventive linkage mechanism showing the relative positioning of members when the housing assembly is in an inclined position.

With particular reference to FIG. 5, the provision of the local constriction 50 provides for a force to be applied against either of the side walls 46 at the local constriction 50 thus causing the bottom link 30 to pivot on post 34. This pivotal motion causes transverse link 26 to reciprocate in a direction generally parallel to the transmission output shaft. This reciprocating motion causes the clutch engaging member 22 to pivot about post 24 and thereby engage either a forward drive clutch 56 or a reverse drive clutch 58.

Figure 4:
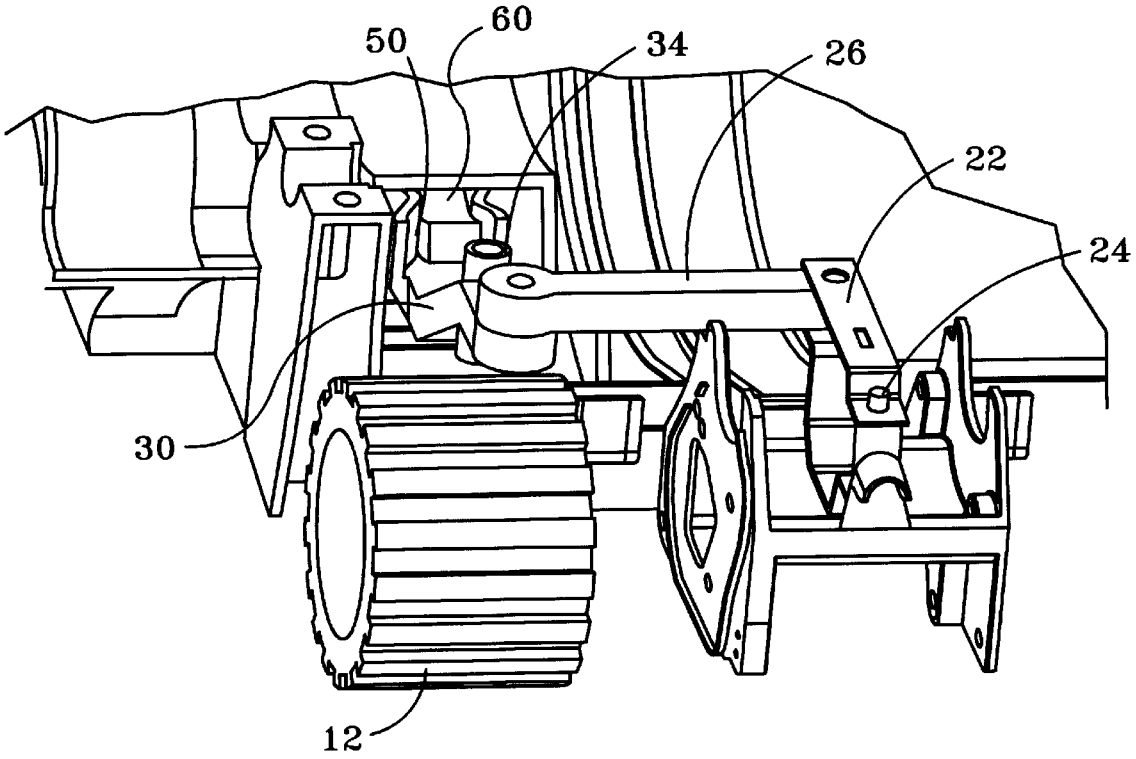
FIG. 4 is a partial perspective view showing the clutch engaging member and a transverse link according to the invention.

With particular reference to FIG. 4, the interconnections of bottom link 30, transverse link 26 and the clutch engaging member 22 are clearly illustrated.

Again with particular reference to FIGS. 3–8, carried on the housing assembly 6 is a finger link 60. Finger link 60 is selectively positionable relative to bottom link 30 depending on the pivotal positioning of the housing assembly. When the housing assembly 6 is in an inclined position, as illustrated in FIGS. 3, 4, 5 and 7, a first end portion of the finger link 60 is received in channel 42 so that the first end portion is positioned within the local constriction 50.

With reference to FIG. 5, finger link 60 is pivotally mounted to the housing assembly 6 (not shown in this view) for pivotal motion about a pivot axis 70. Pivotal movement in a first direction, for instance counterclockwise, causes finger link 60 to engage one of the walls 46 of bottom link member 30. Pivotal movement in the opposite direction causes finger link 60 to engage the other one of the walls 46. A second end of finger link 60 includes an arm 74 which responds to a force acted on the handle portion (not shown in this view) from an operator to cause the pivotal movement of the finger link 60. Arm 74 lies in a plane generally normal to pivot axis 70 (best seen in FIG. 6).

Figure 6:
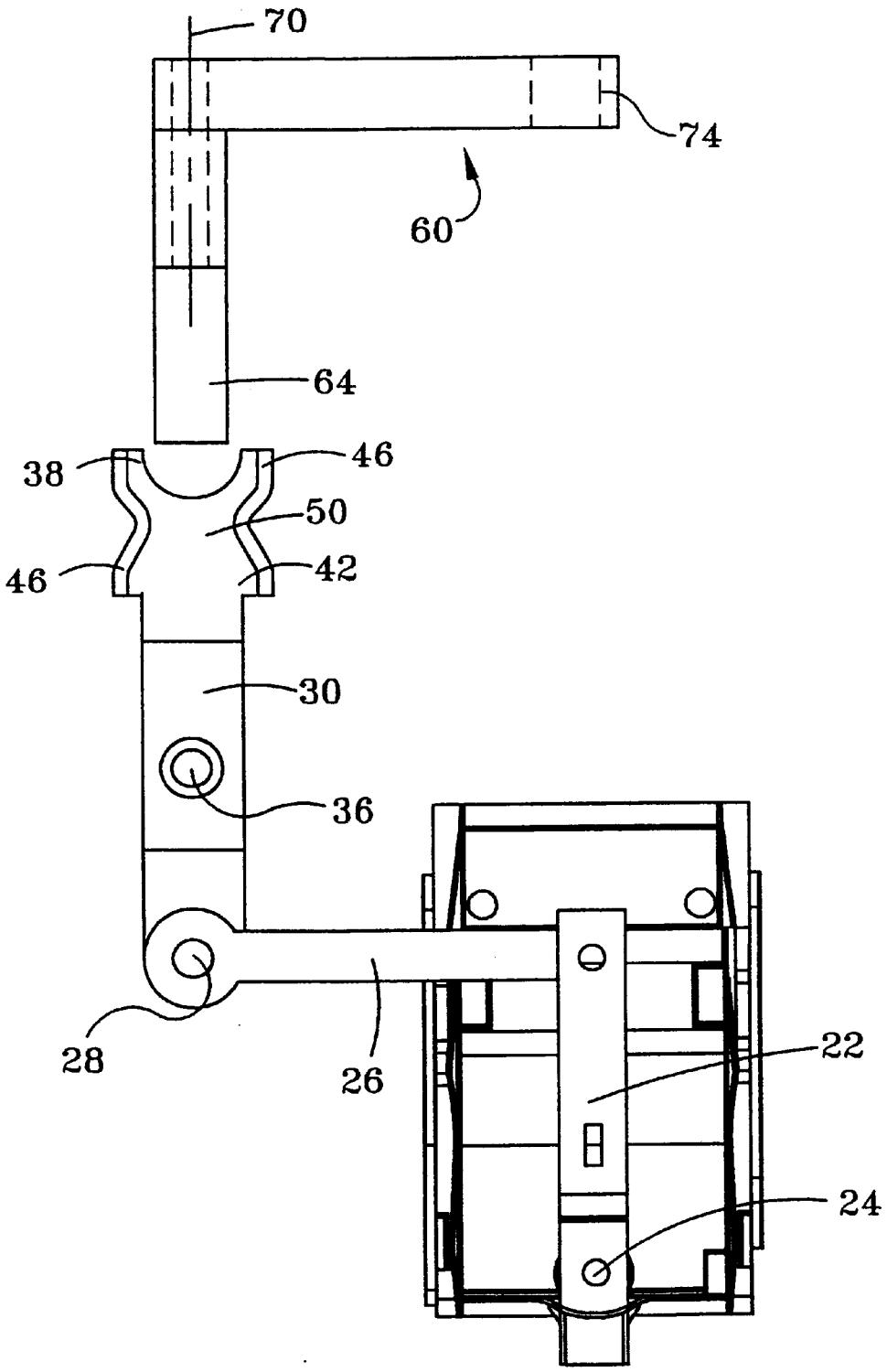
FIG. 6 is a top view of the linkage mechanism of FIG. 5 showing the relative positioning of members when the housing assembly is in an upright position.
Figure 7:
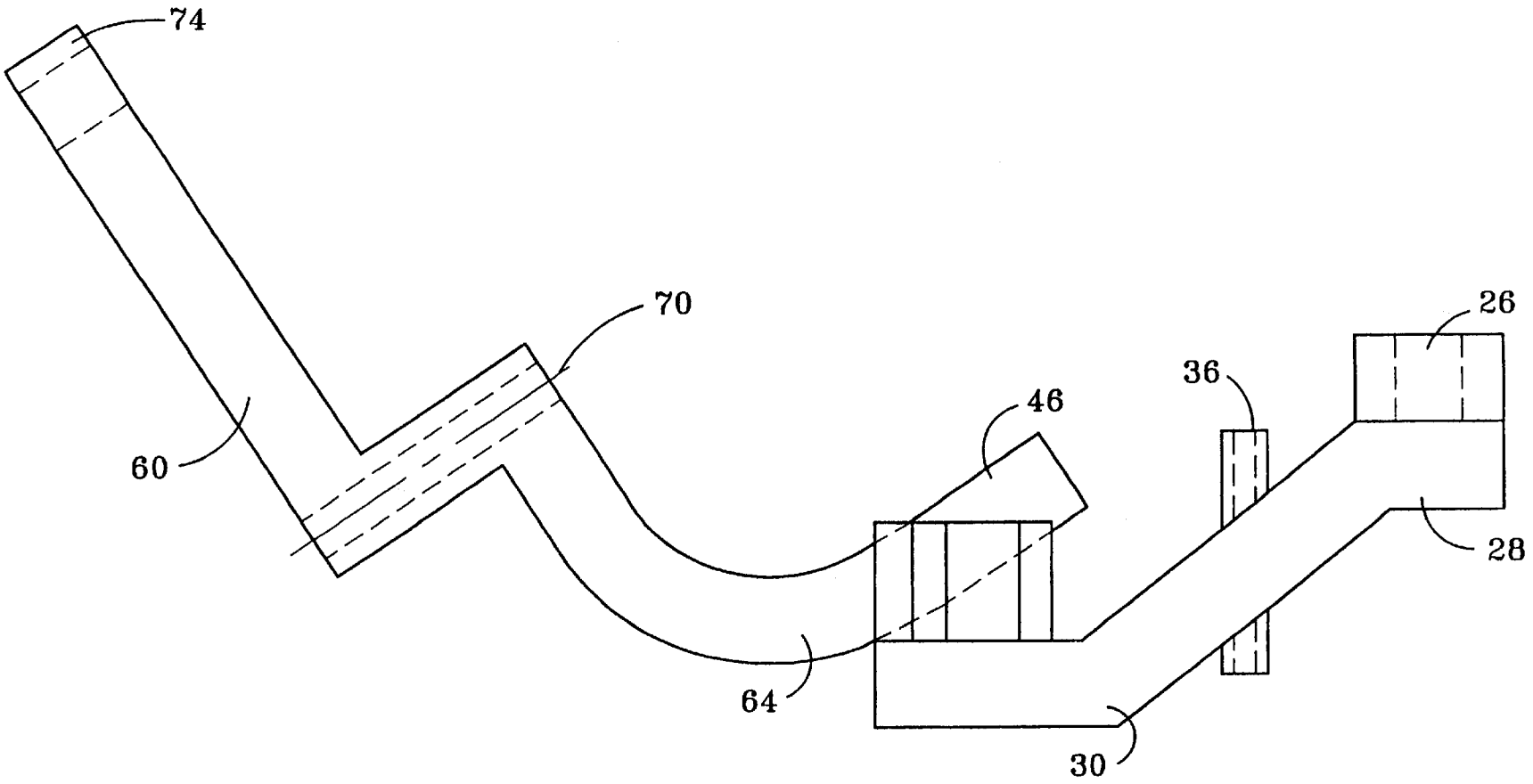
FIG. 7 is a side view of the inventive linkage mechanism shown in FIG. 5.
Figure 8:
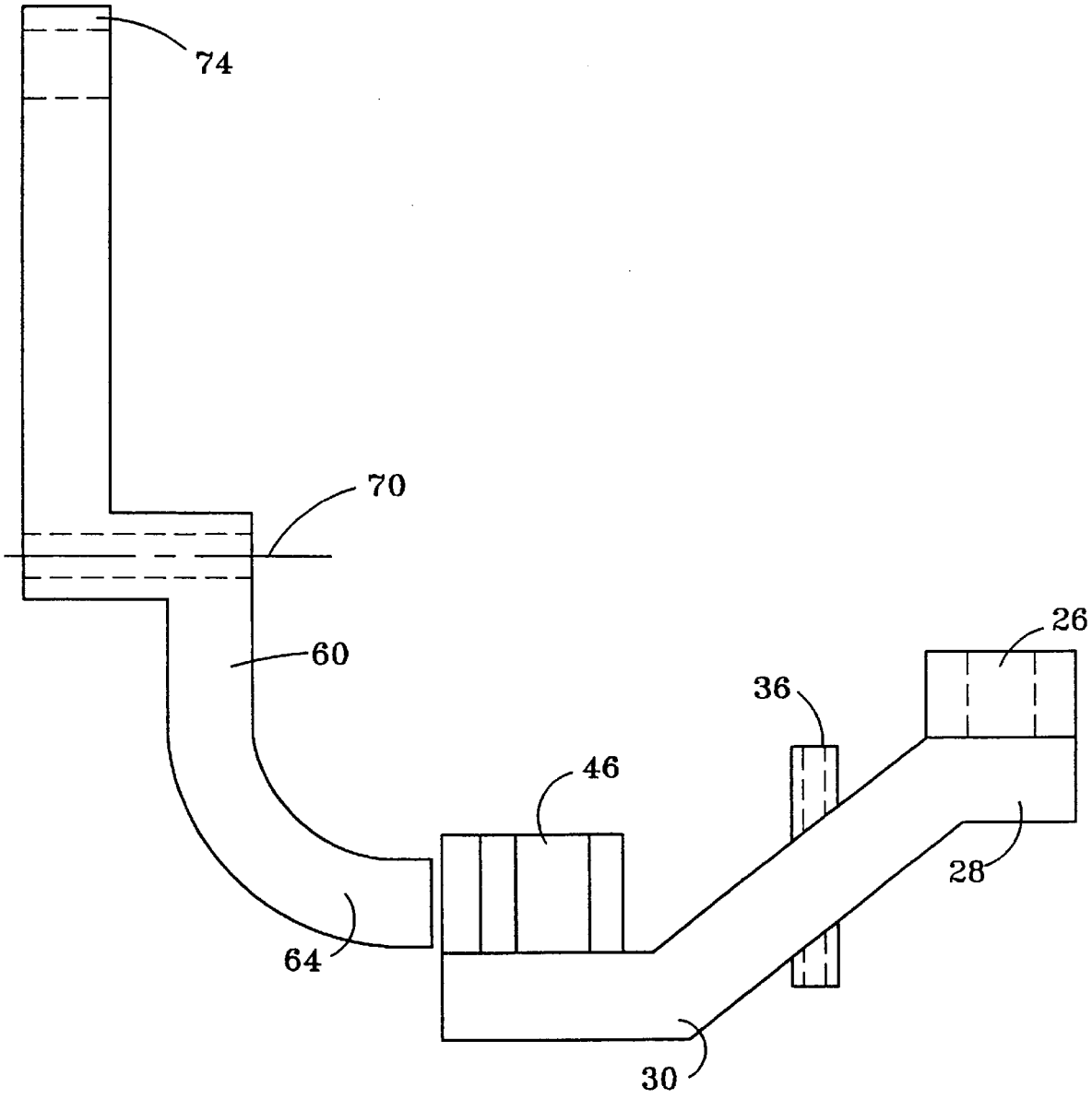
FIG. 8 is a side view of the inventive linkage mechanism shown in FIG. 6; and, FIG. 9 is a partial perspective view of one embodiment of the linkage members which are carried on the housing assembly.

As illustrated in FIGS. 6 and 8, because the finger link 60 is carried on the housing assembly (not shown in these views), when the housing assembly is in an upright storage position, the finger link 60 assumes a different position relative to the bottom link 30. The end portion is not positioned in the local constriction 50 of channel 42, but rather is disengaged from channel 42. Therefore, pivotal motion of finger 60 about pivot axis 70 has no effect on bottom link 30. Therefore, any force from movement of the handle portion is not transferred to bottom link 30 and the transmission 14 is subsequently not engaged. This novel linkage mechanism therefore automatically assumes an inoperable state when the housing assembly is in an upright position.

Figure 9:
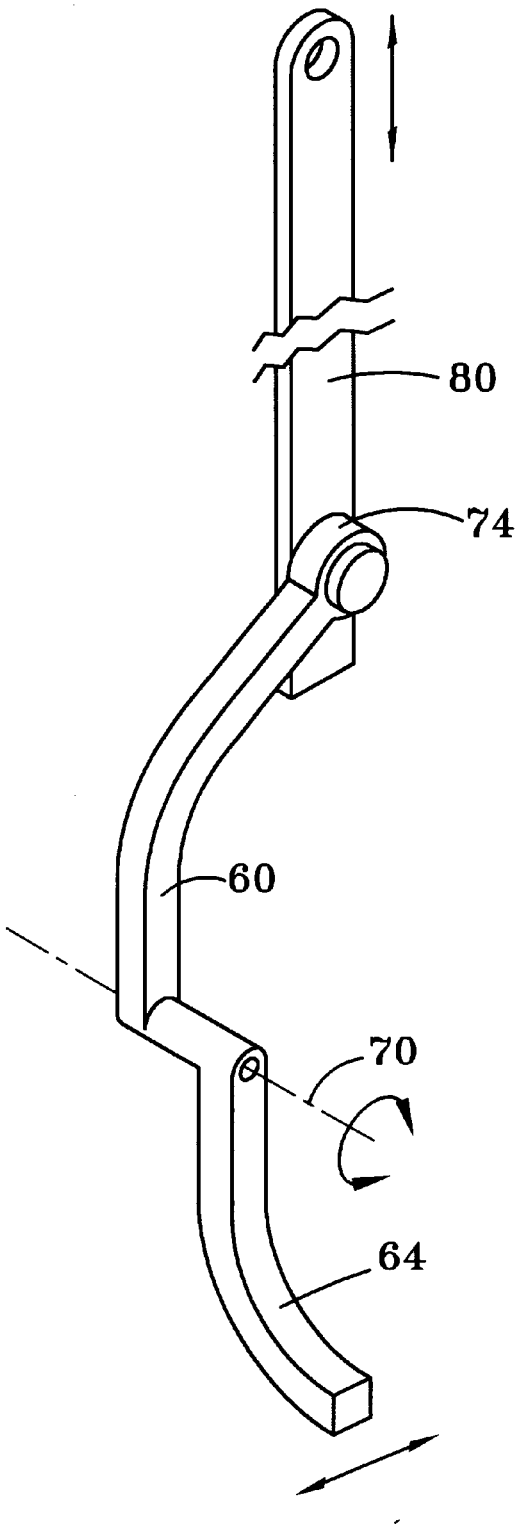

With reference to FIG. 9, the finger link 60 may be connected to the handle portion (not shown) by one or more linking members 80 which function to transfer the reciprocal motion of the handle portion to finger link 60. In the embodiment of FIG. 9, the finger link 60 includes an arcuate portion 64 that encompasses the first end portion so that the first end portion is disposed generally parallel to pivot axis 70.

The operator actuates the transmission 14 of self-propelled vacuum cleaner 2 using the present linkage mechanism by inclining the housing assembly 6 to thereby position the finger link 60 in the operable position relative to the bottom link 30. The operator manipulates the handle portion 16 to selectively engage the finger link 60 with the bottom link 30 thus selectively positioning the transverse link 26 in response to pivotal motion of the bottom link 30. Reciprocating motion of transverse link 26 pivots clutch engaging member 26 to selectively engage the forward drive clutch 56 or the backward drive clutch 58. When an operator pushes the handle portion 16, a series of linking members 80, 60, 30, and 26 causes the clutch engaging member 22 to engage the forward drive clutch 56 whereby the cleaner is propelled forwardly. When an operator pulls on the hand grip 16, the series of linking members 80, 60, 30, and 26 causes the clutch engaging member 22 to engage the reverse drive clutch 58 whereby the cleaner is propelled backwardly. When the hand grip 6 is not being manipulated by an operator, the clutch engaging member 22 remains in a neutral position in which neither drive clutch 56, 58 is engaged.

The operative position of the finger link 60 relative to the bottom link 30 is attained when the first end portion of the finger link 60 is located within the local constriction 50 of channel 42 formed on the bottom link 30.

The transmission 14 is disengaged when the finger link 60 is not engaged within or contacting sidewalls 46 of channel 42 of the bottom link 30. For example, even when the housing assembly 6 is inclined, if the handle portion 16 is not being manipulated, the finger link 60 is centrally located within the local constriction 50 of channel 42 placing the linkage mechanism in a neutral position. Thus, finger link 60 is not acting upon the bottom link 30 and the transmission 14 is not being actuated. When the housing assembly 6 is in an upright position, the finger link 60 is spaced from constriction 50 and does not engage the bottom link 30, even if the handle portion 16 is manipulated.

The present invention has been described above using a preferred embodiment by way of example only. Obvious modifications within the scope of the present invention will become apparent to one of ordinary skill upon reading the above description and viewing the appended drawings. The present invention described above and as claimed in the appended claims is intended to include all such obvious modifications within the scope of the present invention.

What is claimed is:

1. A self-propelled upright vacuum cleaner having a floor engaging portion, a housing assembly pivotally attached to said floor engaging portion for pivotal motion between a generally upright storage position and a pivotal inclined operating position, and a handle portion carried on said housing assembly at a position spaced from said floor engaging portion, said handle portion being adapted for limited reciprocal movement relative to said housing assembly, at least one floor engaging drive wheel mounted to and extending out a lower surface of said floor engaging portion, a transmission operatively connected to said drive wheel and a motor drivingly connected to said transmission for selectively driving said drive wheel in forward and reverse, wherein the improvement comprises:

a clutch engaging member pivotally mounted to said floor engaging portion adjacent to said transmission for pivotal motion about a first pivot axis located generally at a forward portion of said clutch engaging member;

a first linkage for selectively moving said clutch engaging member from a neutral position to a drive position, said first linkage being carried on said floor engaging portion; and, a second linkage for selectively engaging said first linkage, said second linkage being carried on said housing assembly and being operable in response to said reciprocal movement of said handle portion, said second linkage being operably positioned relative to said first linkage when said housing assembly is in the inclined operating position and being inoperably positioned relative to said first linkage when said housing assembly is in the upright storage position.

2. The self-propelled upright vacuum cleaner of claim 1 wherein said first linkage includes:

a transverse linking member operably connected to said clutch engaging member at a location spaced from said first pivot axis and being adapted for reciprocal movement in first and second directions, respectively, from a neutral position to selectively move said clutch engaging member from said neutral position to one of said drive positions; and, a longitudinal linking member pivotally mounted to said floor engaging portion for pivotal motion about a second pivot axis spaced from said transmission, said longitudinal linking member being operably connected at a first end thereof to said transverse linking member whereby pivotal motion of said longitudinal linking member causes said reciprocal movement of said transverse linking member.

3. The self-propelled upright vacuum cleaner of claim 2 wherein:

said second; linkage includes a finger link member having a first end portion, said finger link member being pivotally mounted to said housing assembly at a location spaced from said first end portion for pivotal motion about a third pivot axis; and said longitudinal linking member includes opposed walls defining an open-ended channel at a second end of the longitudinal linking member wherein said walls are modified V-shaped to provide a local constriction in said channel; and wherein said first end portion is positioned at said local constriction when said housing assembly is in said inclined operating position, and wherein said first end portion is spaced from said local constriction when said housing assembly is in said upright storage position.

4. The self-propelled upright vacuum cleaner of claim 1 wherein said second linkage includes:

a finger link member having a first end portion, said finger link member being pivotally mounted to said housing assembly at a location spaced from said first end portion for pivotal motion about a third pivot axis.

5. The self-propelled upright vacuum cleaner of claim 4 wherein said finger link member further includes:

an arm portion spaced from said first end portion being operably connected to said handle portion at a location spaced from said third pivot axis and being responsive to said reciprocal motion of said handle portion to pivot said finger link member about said third pivot axis.

6. The self-propelled upright vacuum cleaner of claim 4 wherein said finger link member further includes:

an arcuate portion encompassing said first end portion.

7. A method of actuating a transmission in a self-propelled vacuum cleaner having a floor engaging portion, a housing assembly pivotally attached to said floor engaging portion for pivotal motion between a generally upright storage position and a pivotal inclined operating position, and a handle portion carried on said housing assembly at a position spaced from said floor engaging portion, said handle portion being adapted for limited reciprocal movement relative to the housing assembly, at least one floor engaging drive wheel mounted to and extending out a lower surface of said floor engaging portion, a transmission operatively connected to said drive wheel and a motor drivingly connected to said transmission for selectively driving said drive wheel in forward and reverse, said method comprising the steps of:

providing a clutch engaging member pivotally mounted to said floor engaging portion adjacent to said transmission for pivotal motion about a first pivot axis located generally at a forward portion of said clutch engaging member;

providing a first linkage for selectively moving said clutch engaging member from a neutral position to a drive position, said first linkage being carried on said floor engaging portion;

providing a second linkage for selectively engaging said first linkage, said second linkage being carried on said housing assembly and being operable in response to said reciprocal movement of said handle portion, said second linkage being operably positioned relative to said first linkage when said housing assembly is in said inclined operating position and being inoperably positioned relative to said first linkage when said housing assembly is in said upright storage position;

inclining said housing assembly to operably position said second linkage;

manipulating said handle portion to operate said second linkage and thereby selectively engage said first linkage; and, selectively moving said clutch engaging member with said first linkage from said neutral position to said drive position.

8. A linkage mechanism for actuating a transmission in a self-propelled upright vacuum cleaner having a floor engaging portion, a housing assembly pivotally attached to said floor engaging portion for pivotal motion between a generally upright storage position and a pivotal inclined operating position, and a handle portion carried on said housing assembly at a position spaced from said floor engaging portion, said handle portion being adapted for limited reciprocal movement relative to said housing assembly, at least one floor engaging drive wheel mounted to and extending out a lower surface of said floor engaging portion, wherein said transmission is operatively connected to said drive wheel and a motor drivingly connected to said transmission for selectively driving said drive wheel in forward and reverse, the linkage mechanism including:

a clutch engaging member pivotally mounted to said floor engaging portion adjacent to said transmission for pivotal motion about a first pivot axis located generally at a forward portion of said clutch engaging member;

a transverse link member operably connected to said clutch engaging member at a location spaced from said first pivot axis and being adapted for reciprocal movement in first and second directions, respectively, from a neutral position to selectively move said clutch engaging member from said neutral position to said drive position;

a bottom linking member pivotally mounted to said floor engaging portion for pivotal motion about a second pivot axis spaced from said transmission, said bottom linking member being operably connected at a first end thereof to said transverse linking member whereby pivotal motion of said bottom linking member causes said reciprocal movement of said transverse linking member, said bottom linking member comprising opposed walls defining an open-ended channel at a second end of the bottom linking member wherein said walls are modified V-shaped to provide a local constriction in said channel; and, a finger link member having a first end portion and an arm portion spaced from said first end portion, said finger link member being pivotally mounted to said housing assembly at a location spaced from said first end portion for pivotal motion about a third pivot axis wherein said first end portion is positioned at said local constriction when said housing assembly is in said inclined operating position whereby pivotal motion of said finger link member causes selective pivotal motion of said bottom link, and wherein said first end portion iss spaced from said local constriction when said housing assembly is in said upright storage position whereby pivotal motion of said finger link member does not cause pivotal motion of the bottom link, said arm portion being operably connected to said handle portion at a location spaced from said third pivot axis and being responsive to said reciprocal motion of said handle portion of pivot said finger link member about said third pivot axis.

* * * * *